United States Patent [19]

Austin

[11] 4,088,862

[45] May 9, 1978

[54] TIMER OPERATED CONTROL CIRCUIT FOR A MICROWAVE OVEN

[75] Inventor: Buddy Julian Austin, Lafayette, Ind.

[73] Assignee: Roper Corporation, Kankakee, Ill.

[21] Appl. No.: 674,819

[22] Filed: Apr. 8, 1976

[51] Int. Cl.[2] ..... H05B 9/06

[52] U.S. Cl. ..... 219/10.55 B; 307/141

[58] Field of Search ..... 219/10.55 R, 10.55 B; 307/141

[56] References Cited

U.S. PATENT DOCUMENTS

| | | | |
|---|---|---|---|
| 3,694,608 | 9/1972 | Loubert et al. | 219/10.55 B |
| 3,824,365 | 7/1974 | Tapper | 219/10.55 B |
| 3,842,233 | 10/1974 | Lamb | 219/10.55 B |
| 3,943,317 | 3/1976 | Nagamoto | 219/10.55 B |

*Primary Examiner*—J. V. Truhe
*Assistant Examiner*—Clifford C. Shaw
*Attorney, Agent, or Firm*—Leydig, Voit, Osann, Mayer & Holt, Ltd.

[57] ABSTRACT

A control circuit for a microwave oven including a main timer for setting the period of operation and having a high power mode in which power is continuously supplied to the microwave generator for the entire timed period, and a defrost or low power mode wherein power is supplied at a reduced duty cycle for the selected time period. The circuit, in addition to the main timer operable in both modes, includes a defrost timer operable only in the defrost mode for periodically interrupting the power circuit for the microwave generator thereby to provide reduced duty cycle operation. The circuit further includes means for automatically resetting the defrost timer after operation thereof to assure that the microwave generator will be instantly energized upon subsequent operation, independently of the subsequently selected mode.

7 Claims, 2 Drawing Figures

TIMER OPERATED CONTROL CIRCUIT FOR A MICROWAVE OVEN

This invention relates to microwave ovens, and more particularly to an improved timer operated control circuit for selectively providing high or low power operation.

Microwave ovens have been used for some time, and the advantages of those ovens both in rapid cooking of foodstuffs and also in rapid thawing of frozen foods are known. It has also been appreciated that when used in defrosting, pulsed power is preferable to full power cooking in that the heat generated during the power on period is allowed to dissipate into the frozen product before application of a subsequent power burst. Such operation allows the frozen product to be thawed without substantial cooking of the outer layers.

The prior art has evolved to include automatic timer circuits for controlling both high power and low power cooking. Such a circuit is illustrated in the Tapper U.S. Pat. No. 3,824,365, which shows a main timer for controlling the overall period of operation, and a defrost timer for providing pulsed power during the defrost mode. However, that circuit suffers from a serious deficiency in that circuit operation is completely terminated in both modes when the main timer switches off, with the result that the defrost timer is deenergized at random points in its cycle. As a result, initiation of a defrost cycle often starts with an off period, providing a source of confusion to the user. Realizing that the duty cycle for defrost operation is often selected as 30 seconds on, 30 seconds off, it will be appreciated that the potential exists for a substantial lapse of time between energization of the circuit by the user and any apparent response thereto. This time lapse may appear as a fault to the user, and may result in needless service calls. Further, instant energization of the microwave source in the full power mode is achieved only at the expense of a selector switch in the main power circuit of high current carrying a capability and associated wiring of correspondingly heavy gauge.

In view of the foregoing, it is an object of the present invention to provide a control circuit for a microwave oven including a an timer for establishing the overall period of operation, a selectively energizable defrost timer for providing reduced duty cycle operation, and means for resetting the defrost timer following operation thereof so that the circuit is instantly energized in subsequent operations in both high power and defrost modes.

An object, according to another feature of the invention, is to provide a control circuit for a microwave oven having a defrost selector switch wherein the defrost selector switch is coupled in a low current control circuit and may thus be implemented by a light duty switch and associated wiring of relatively light gauge.

Figure 1:
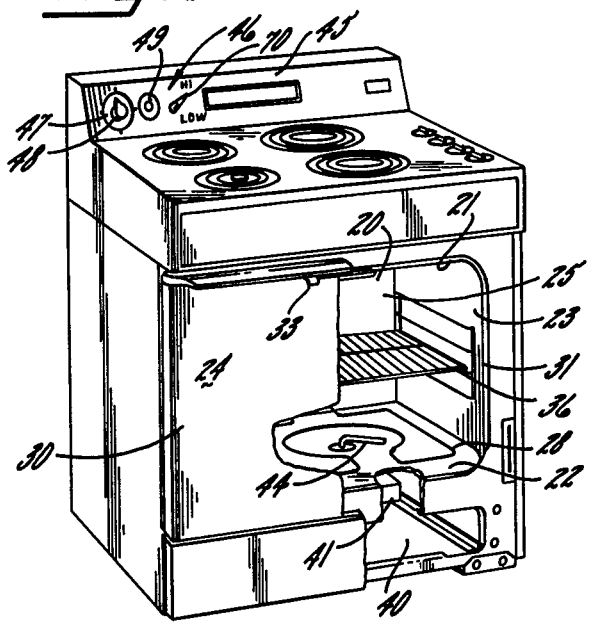
Figure 2:
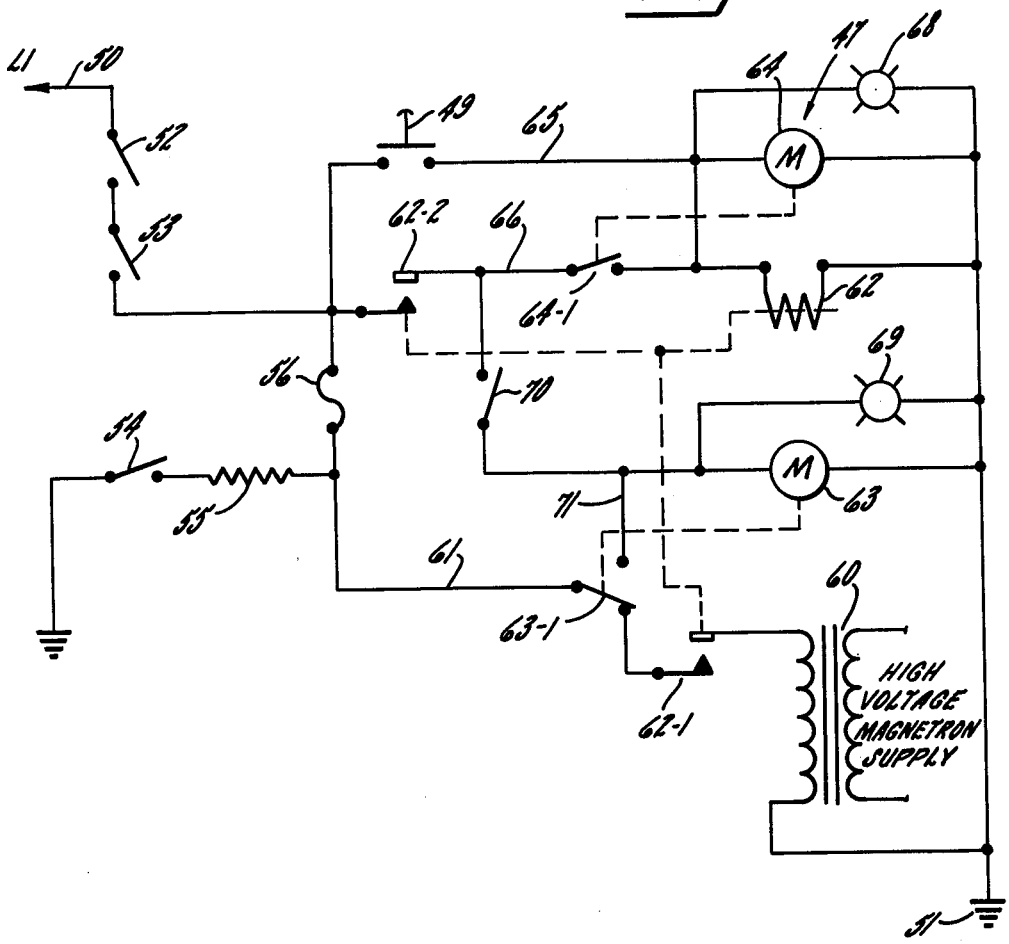

Other objects and advantages will become apparent from the following detailed description, when taken in conjunction with the drawings, in which:

FIG. 1 is a perspective view of a free standing electric range incorporating a source of microwave energy and illustrating the use of a timer circuit according to the present invention; and FIG. 2 is a circuit diagram showing a timer circuit exemplifying the present invention.

While the invention will be described in connection with a preferred embodiment, it will be understood that there is no intent to limit it to that embodiment. On the contrary, the intent is to cover all alternatives, modifications and equivalents included within the spirit and scope of the invention as defined by the appended claims.

Turning now to the drawings, FIG. 1 shows a typical free standing electric range incorporating a source of microwave energy and illustrating the use of a timer control circuit according to the present invention. The range has an oven cavity 20 formed by an enclosure including a top wall 21, a bottom wall 22, side walls 23, 24 and a back wall 25. Spaced downwardly a short distance from the top wall 21 is a heating element (not shown). A second heating element 28 is spaced a short distance above the bottom wall 22. The front access opening of the cavity is closed by a hinged door 30. An energy seal, indicated schematically at 31, completely surrounds the oven enclosure at the door-enclosure interface and provides both temperature sealing for cooking, pyrolytic cleaning and energy sealing to prevent leakage of microwave radiation. A door latch 33 is provided to actuate associate interlocking switches so as to assure that the oven door is properly closed before the microwave or pyrolytic cleaning capabilities may be activated. Within the oven cavity is a grid type shelf 36; it will be understood that more than one such shelf may be used, if desired.

Conveniently located below the oven cavity in a storage space 40 is a module 41 adapted to function as a microwave generator. As is well known, such microwave generator generally comprises a magnetron for supplying microwave energy at a particular frequency to be used in cooking foodstuffs located within the oven cavity. For distributing the microwave energy throughout the oven cavity, an antenna 44 has its feed end electrically coupled to the microwave source and its distribution end projecting into the oven cavity. The particular antenna illustrated is of the rotating type, being rotated about its vertical central axis at a relatively low rate (such as 3 or 4 rpm) to couple evenly distribute microwave energy from the magnetron into the oven cavity.

Among the controls located on the control panel 45 are a grouping, generally indicated at 46, for controlling and timing oven operation in the microwave mode. A main timer 47 having a control knob 48 may be set by the user to select the overall period of time during which the microwave source will be energized. The time period is initiated by depression of push to start switch 49. A selector switch 70 is also provided, being adapted to select the high power cooking mode in a first position, or the low power or defrost mode in a second position. Thus, in order to operate the microwave capability of the oven, it is necessary for an operator to select the high power or low power mode, to set the timer 47 via control knob 48 to the desired period of operation, and to initiate the timed period of operation, by momentarily depressing push to start switch 49. Such action causes the microwave source to be energized in the selected mode until the period set upon timer 47 elapses at which time the microwave source is automatically deenergized. If the operator had selected the high power mode, the microwave source would have been continually energized throughout the timed period. By way of contrast, if the operator had selected the defrost mode, the microwave source would have been alternately energized and deenergized during the timed period, typically at a 50% duty cycle — 30 seconds on, 30 seconds off.

It should be noted at this point that the foregoing description of the oven configuration is offered solely as an exemplary environment for the control circuit according to the present invention. It will, thus, be apparent that the control circuit to be described below may be used in the illustrated oven, as well as in numerous variations thereof, including ovens without radiant heating capabilities, portable ovens, and the like.

Turning now to FIG. 2, there is shown an exemplary embodiment of a control circuit capable of operation in the mode functionally described above. Both the microwave generator and the control circuit are powered from the a.c. line voltage power spply illustrated as line L1 indicated at 50 and ground or circuit common, indicated at 51. Interposed between the power line 50 and the control circuit are interlocking contacts 52, 53, responsive to the position of the latch 33, and arranged to assure that no power is provided to the circuit unless the latch is properly locked. A further safety feature is provided by latch monitor switch 54 which is arranged to be closed when the door is not in its properly locked condition. The latch monitor switch 54 serves as a check on interlocking switches 52 and 53, assuring that they are not welded in their closed position. If that occurs, and the microwave capability is activated with the latch 33 in its unlatched condition, current would flow from the source through the latch monitor switch 54 to ground, causing current flow through the heater 55. The heater 55 is physical associated with fuse 56 so that current flow through the heater 55 generates heat which serves to open the fuse 56 thereby opening the main power circuit to the microwave generator. The interlocking circuitry forms no part of the present invention and, thus, will not be described in greater detail. Suffice it to say, that if the interlocking circuitry is operating properly, and the latch is properly locked, a.c. power will be coupled though the switches 52 and 53 while switch 54 remains open so that the fuse 56 will retain its integrity.

Illustrated in the lower portion of FIG. 2 is a transformer 60, representing the microwave generator. Typically, the transformer 60 is an element of the magnetron power supply, and has a high voltage secondary for supplying voltage of the needed magnitude for operation of the magnetron. The microwave generator is not illustrated in greater detail because the particular nature of that generator forms no part of the present invention.

For supplying primary power to the magnetron transformer 60 for energization thereof, a main power circuit generally indicated at 61 is provided coupling the a.c. lines 50, 51 to the primary of transformer 60. Interposed in the main power circuit 61 are power contacts 62-1 and defrost timer contacts 63-1, serially coupled so that operation of such contacts controls the application of power from the power supply to the microwave generator.

Attention will first be focused upon operation of the control circuit in the high power mode. As will become more apparent, the defrost timer contacts 63-1 are normally maintained in the position illustrated in FIG. 2, thereby to complete the portion of the main power circuit 61 controlled by the defrost timer contacts. In this condition, and ignoring the aforementioned interlocking switches, the power contacts 62-1 are the only control for supplying a.c. power from the source to the magnetron. To achieve timed operation, the power contacts 62-1 are made responsive to the main timer 47 so that the contacts are closed while the main timer is being driven to time out a preset period, and are opened at the termination of the period. To that end, the main timer 47 has a timing element, illustrated as timer motor 64 connected in a main timer circit wherein one terminal is coupled to power line 51, and a second terminal is coupled through parallel starting circuit 65 and latching circuit 66 to the power line 50. The timer 64 has contacts 64-1 interposed in the latching circuit 66. Such contacts are responsive to the condition of the timer 64, being in the illustrated open position when the timer is in its timed out position, and in the alternate or closed position when the timer is off-normal. Coupled in parallel with the timer motor 64 is a relay coil 62 which controls the contacts 62-1 serially coupled in the main power circuit 61 and the contacts 62-2 serially coupled with the contacts 64-1 in the latching circuit 66. To indicate operation of the system to the user, an indicator light 68, such as neon lamp, is coupled in parallel with the timer motor 64.

It should be noted that the timer 64 is illustrated as being of the motor driven variety, typically having a cam arrangement to drive the associated contacts 64-1. However, it will be appreciated that other forms of timing devices, such as electronic timers may be used, if desired.

To operate the system in the high power mode, the user simply presets the desired time period on the main timer 47 by rotating the control knob 48 to indicate the desired length of operation. Rotating the control knob serves to move the timer motor 64 to its off-normal position, closing contacts 64-1. When the user desires to commence operation, he initiates the time period by a momentary depression of the push to start switch 49. This action couples a.c. power through the switch 49, causing the timer motor 64 to begn to rotate, and energizing the relay coil 62. Energization of the relay coil 62 serves to close contacts 62-2, thereby completing the latching circuit and maintaining power to both the relay coil 62 and the timer motor 64. Additionally, the contacts 62-1 are closed, thereby to complete the main power circuit 61, supplying power from the a.c. source to the magnetron. It will be appreciated that after the latching circuit 66 is completed, the user may release the push to start switch 49 without effect upon the circuit. The timer motor 64 continues to rotate, thereby to measure the selected timing period. When the period is at an end, the timer causes the contacts 64-1 to return to their open position, thereby breaking the latchng circuit 66. As a result, relay coil 62 is deenergized, opening contacts 62-2 in preparation for the next cycle of operation and opening contacts 62-1 to deenergize the magnetron.

For providing operation of the oven at low power for use in defrosting and low power cooking, means for reducing the duty cycle of magnetron operation are provided, shown herein as defrost timer 63. The timer is motor driven and includes cntacts 63-1 normally maintained in the illustrated or normally-closed position, but alternating between the illustrated and normally-open positions at a predetermined rate, such as 30 seconds on, 30 seconds off when the timer is energized. Since the contacts 63-1 are serially coupled in the main power circuit 61, it is seen that this will cause the magnetron to operate at the reduced duty cycle determined by the defrost timer 63. It should be noted that the timer 63 need not be made available to the user, being preset at the factory for a desired duty cycle.

A second neon lamp 69 is coupled in parallel with the defrost timer motor 63 so that such lamp glows during the entire defrost cycle.

For selecting between the high power and low power modes, a selector switch 70 is provided, having a first terminal coupled to the latching circuit 66 intermediate the contacts 62-2 and 64-1, and a second terminal coupled to the defrost timer motor 63. In the high power mode the switch 70 is in the position illustrated in FIG. 2, thereby disconnecting the defrost timer 63 from the control circuit. When it is desired to operate the system in the defrost mode, the switch 70 is moved to its alternate position, completing a path from the latching circuit 66 to the defrost timer 63.

In accordance with the invention, an automatic defrost timer resetting circuit is provided so that, following a defrost cycle of operation, the magnetron may be instantly energized in subsequent cycles irrespective of selection of the high or defrost cycle modes. To that end, a connection 71 is provided between the defrost timer motor 63 and the normally open pair of the contact set 63-1. As will become more apparent, such connection maintains the energization of the defrost timer 63 after deenergization of the main timer 64 if the contacts 63-1 are in their off-normal position, causing the defrost timer 63 to continue operation until the contacts 63-1 are returned to the position illustrated in FIG. 2.

Operation in the defrost mode is substantially as follows: The user selects the overall length of the defrost cycle by setting the appropriate time on the main timer 47. As described in the previous case, this action serves to close contacts 64-1, thereby preparing the circuit for operation. In addition, the user selects the defrost mode by changing switch 70 to its alternate position thereby completing the circuit between latching circuit 66 and the defrost timer motor 63. The user then initiates operation by a momentary depression of the push to start switch 49. Such action energizes the relay coil 62, thereby completing the latching circuit 6. Additonally, since the contacts 63-1 begin every cycle in their illustrated position, closing of contacts 62-1 instantly energizes the magnetron generator 60. Further, power is coupled from the latching circuit 66 to the defrost timer motor 63, causing the defrost timer to operate thereby to set up pulsed operation. In this condition both the lamps 68 and 69 are glowing indicating that the circuit is operating and the defrost mode is energized. The defrost timer motor 63 serves to alternate the position of contacts 63-1 at the selected interval, such as 30 seconds. As a result, the microwave generator is alternately energized and deenergized in time with the closing and opening of contacts 63-1. However, the timer motor 63 is maintained in the energized condition through the selector contacts 70. The control circuit continues to alternately energize and deenergize the microwave source until the main timer 64 reaches the termination of its preselected period, thereby opening contacts 64-1 and breaking the latching circuit 66. As a result, the relay coil 62 is deenergized, opening contacts 62-2 to prepare for the next cycle of operation, and opening contacts 62-1 to deenergize the magnetron. If the main timer 64 deenergizes the circuit at a point when the contacts 63-1 were in their illustrated position, the circuit would then be completely deenergized and prepared for the next cycle. If however the contacts 63-1 were in their alternate position, power would be supplied through the normally open set of contacts 63-1 and the automatic reset circuit 71 thereby to maintain the defrost timer motor 63 energized even after deenergization of the main timer 64. Although the magnetron 60 is deenergized at this point due to the open condition of contacts 62-1, the defrost timer 63 will continue to operate until the contacts 63-1 are switched to their illustrated position. As a result, subsequent operation of the circuit, either in the high power or defrost modes, would find the contacts 63-1 in their illustrated position thereby to instantly energize the magnetron upon depression of the push to start switch 49. As a further advantage of the invention, it will be appreciated that the selector contacts 70 need carry only the current required by the timer motor 63, such current being at least an order of magnitude less than would be required if the selector switch 70 were positioned in the main power circuit 61.

I claim as my invention:

1. A control circuit for controlling a power circuit between a power supply and a microwave generator in a microwave oven, said control circuit comprising in combination, main timer means settable for a selected period for completing the power circuit for said selected period, defrost timer means selectively energizable in conjunction with said main timer and operable between open and closed conditions for periodically making and breaking said power circuit thereby to operate said microwave generator at a reduced duty cycle for said selected period, and means for automatically resetting said defrost timer to the closed condition at the end of said selected period, thereby to assure instant energization of said microwave generator on subsequent timed operations.

2. A control circuit for coupling a power supply to a microwave generator in a microwave oven, said control circuit comprising in combination, a main timer including associated main timer contacts, means for setting the main timer for selecting a period of operation for said microwave oven, a main timer circuit including said main timer and contacts for energizing and deenergizing said main timer, a main power circuit coupling said power supply to said microwave generator and including power switch means responsive to the main timer circuit, a selectively energizable defrost timer, defrost timer contacts interposed in the main power circuit and responsive to the defrost timer, said defrost timer contacts having a first position for closing said main power circuit and a seocond position for opening same, said defrost timer in the energized condition serving to periodically switch said defrost timer contacts between their first and second positions thereby to operate said microwave source at a reduced duty cycle, and means for maintaining the energization of the defrost timer after deenergization of said main timer and until said defrost timer contacts return to their first position thereby to reset said defrost timer.

3. The control circuit as set forth in claim 2 including selector switch means for selectively energizing the defrost timer, said selector switch operable between a high power position for disconnecting said defrost timer from the power supply and a defrost position for energizing said defrost timer.

4. The control circuit as set forth in claim 2 further including a push to start switch interposed between the power supply and the main timer in the main timer circuit so that actuation of said push to start switch serves to initiate a timed cycle of operation.

5. A control circuit for coupling a power supply to a microwave generator in a microwave oven, said control circuit comprising in combination, a main timer settable to select a period of operation for said microwave oven, push to start switch means coupled between the power supply and the main timer for initiating a timed period of operation, an interlockng circuit including interlocking switch means responsive to said main timer for bypassing said push to start switch means thereby to maintain the energization of said main timer after the push to start switch is operated and until the termination of the timed period, a main power circuit coupling said power supply to said microwave generator, power contacts responsive to the main timer and interposed in the main power circuit, a selectively energizable defrost timer having defrost timer contacts responsive thereto and interposed in said main power circuit, said defrost timer contacts having a first position for completing said main power circuit and a second position for interrupting same, energization of the defrost timer serves to periodically switch said defrost timer contacts between their first and second positions thereby to operate said microwave generator at a reduced duty cycle, and circuit means for coupling said power supply to said defrost timer when said defrost timer contacts are in their second position to maintain the defrost timer energized following deenergization of the main timer until said defrost timer contacts return to their first position, whereby said defrost timer is automatically reset following operation thereof.

6. The control circuit as set forth in claim 5 further including relay means having a coil paralleled with the main timer, first contacts interposed in the main power circuit for controlling said circuit, and second contacts interposed in said interlocking circuit.

7. The control circuit as set forth in claim 5 including selector switch means coupled between said interlocking circuit and said defrost timer, said selector switch having a first position for energizing said defrost timer in conjunction with said main timer and a second position for preventing energization thereof.

* * * * *